US008209800B2

(12) United States Patent
Shih

(10) Patent No.: US 8,209,800 B2
(45) Date of Patent: Jul. 3, 2012

(54) SINGLE DRIVER CONNECTING STRUCTURE FOR AN ELECTRIC BED OR CHAIR

(75) Inventor: Lung-Tan Shih, Lukung Town (TW)

(73) Assignee: Ruoey Lung Enterprise Corp., Changhua Hsien, Lukung Town (TW)

( * ) Notice: Subject to any disclaimer, the term of this patent is extended or adjusted under 35 U.S.C. 154(b) by 471 days.

(21) Appl. No.: 12/607,975

(22) Filed: Oct. 28, 2009

(65) Prior Publication Data

US 2011/0094032 A1 Apr. 28, 2011

(51) Int. Cl.
*A47G 7/018* (2006.01)

(52) U.S. Cl. ..... 5/614; 5/616

(58) Field of Classification Search ..... 5/613–618, 5/600, 610

See application file for complete search history.

(56) References Cited

U.S. PATENT DOCUMENTS 4,996,731 A * 3/1991 Kruyt ..... 5/618
5,095,562 A * 3/1992 Alexander ..... 5/616
RE35,201 E * 4/1996 Krauska ..... 5/618

* cited by examiner

*Primary Examiner* — Fredrick Conley
(74) *Attorney, Agent, or Firm* — Muncy, Geissler, Olds & Lowe, PLLC

(57) ABSTRACT

A single driver connecting structure for an electric bed or chair comprises: a primary frame, a driver and a link rod. The second structural component has two first angle brackets, and the first angle brackets each include a sliding slot. The third structural component has two second angle brackets, and each second angle bracket includes an aperture. The driver has a positioning portion and an extendable rod, and the positioning portion is pivoted to the securing aperture. The link rod has a first aperture and a second aperture. The first aperture is pivoted to the through hole of the driver with a control pin, and the control pin is slibable in, and limited in, the sliding slot. The second aperture and the aperture of the third structural component are pivoted together such that the driver drives the link rod to affect different movements of the main frame.

8 Claims, 8 Drawing Sheets

SINGLE DRIVER CONNECTING STRUCTURE FOR AN ELECTRIC BED OR CHAIR

BACKGROUND OF THE INVENTION

1. Field of the Invention

The present invention relates to a single driver connecting structure for an electric bed or chair, and more particularly to a connecting structure capable of multiple pivoted movements.

2. Description of the Related Art

Currently, most bed frames are designed for a user to lay flat while sleeping, and a typical bed frame includes four legs and supports. However, due to the stresses of modern life, many people suffer from insomnia and therefore suffer from a lack of sufficient rest. Consequently, many bed frames have included additional features, such as providing electrical head or leg lifting capabilities, and the user can select and adjust proper positions for him or herself. In the prior art, an electromechanical bed frame includes an upper portion frame, a fixed portion frame, and a lower portion frame. When the user wants to lift his or her head higher, the upper portion frame pivots around a connection region between the upper portion frame and the fixed portion frame to lift the other end of the upper portion frame; if the user wants to lift his or her lower legs higher, the lower portion frame pivots around the connection area between the lower portion frame and the fixed portion frame to lift the other end of the lower portion frame. However, the prior art bed structure can only lift one area at a time, which may be uncomfortable for the user.

Therefore, it is desirable to provide a single driver connecting structure for an electrical bed or chair to mitigate and/or obviate the aforementioned problems.

SUMMARY OF THE INVENTION

An objective of the present invention is to provide a single driver connecting structure for an electrical bed or chair, which is capable of multiple pivoted movements.

A single driver connecting structure for an electric bed or chair comprises: a primary frame, a driver and a link rod. The primary frame includes a first structural component, a second structural component and a third structural component. The first structural component and the second structural component are pivoted together via a first connecting element, and the second structural component and the third structural component are pivoted together via a second connecting element. The first structural component has a securing aperture. The second structural component has two first angle brackets adjacent to the first structural component, and the first angle brackets each include a sliding slot. The sliding slot is an elongate strip slot with a front semicircular end and a rear semicircular end. The third structural component has two second angle brackets adjacent to the second structural component, and each second angle bracket includes an aperture. The securing aperture, the first angle bracket, and the second angle bracket of the primary frame are all disposed along a same direction, and the sliding slot of the first angle bracket is parallel with the second structural component. The driver may include an electrical motor, a pneumatic device or a hydraulic device. The driver has a positioning portion at one end and an extendable rod at another end, and the positioning portion is pivoted to the securing aperture of the first structural component by way of a first pin. The extendable rod includes a through hole at an end of the extendable rod, and the through hole is aligned with the sliding slot of the second structural component. The link rod has a first aperture at one end and a second aperture at another end. The first aperture is pivoted to the through hole of the driver with a control pin, and the control pin is slibable in, and limited in, the sliding slot of the second structural component. The second aperture and the aperture of the third structural component are pivoted together with a second pin such that the driver drives the link rod to affect different movements of the main frame.

With the above-mentioned structure, the present invention provides the following characteristics: when the driver pushes the control pin to slide in the sliding slot, before the control pin presses against the front semicircular end, only the third structural component is pivoted; when the control pin reaches the front semicircular end and presses against the front semicircular end, the second structural component is pivoted too.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
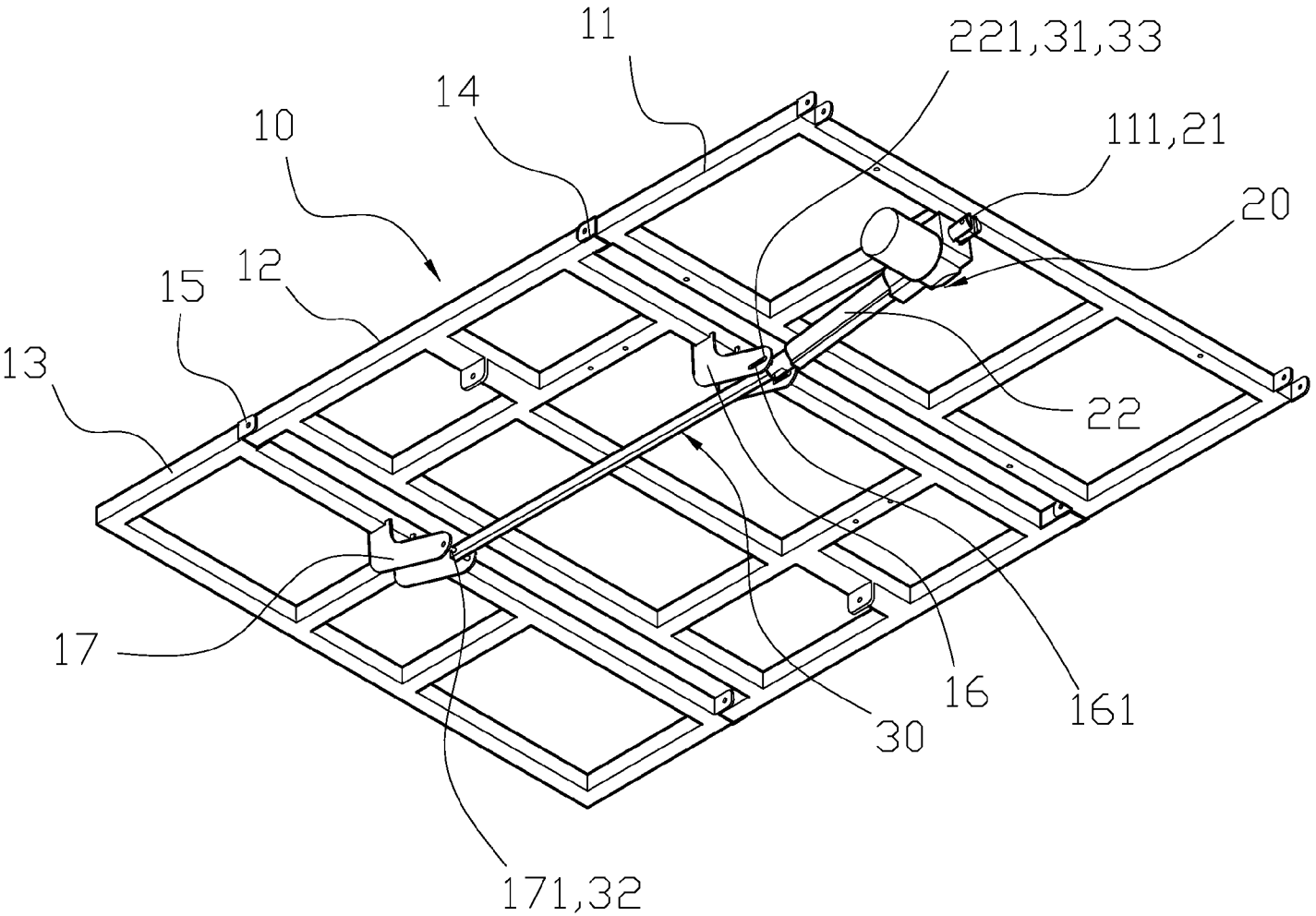
FIG. 1 is a perspective view of an embodiment of the present invention.
Figure 2:
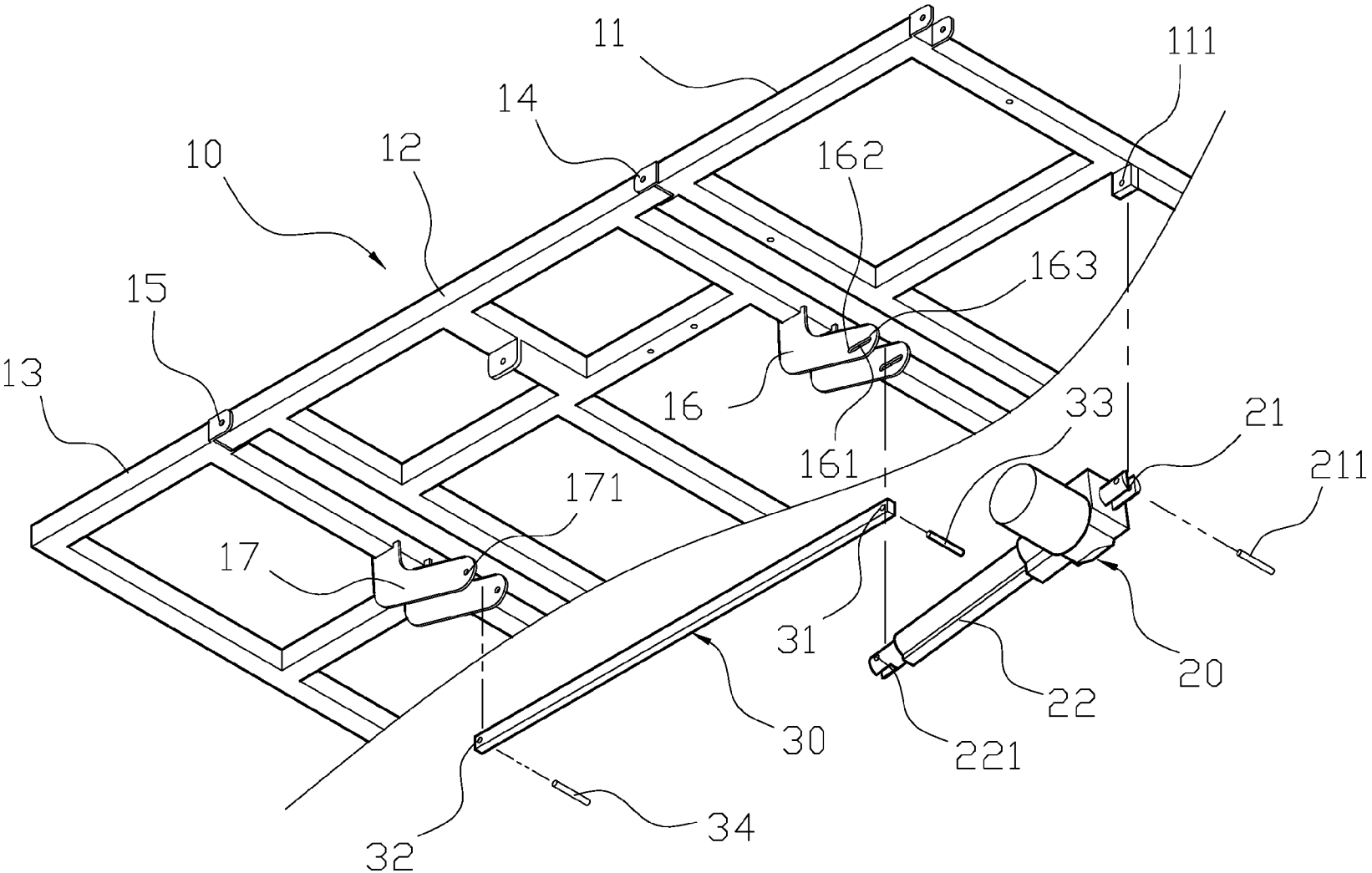
FIG. 2 is an exploded view of an embodiment of the present invention.

Please refer to FIG. 1 and FIG. 2. A single driver connecting structure for an electric bed or chair comprises: a primary frame 10, a driver 20 and a link rod 30. The primary frame 10 includes a first structural component 11, a second structural component 12 and a third structural component 13. The first structural component 11 and the second structural component 12 are pivoted together via a first connecting element 14, and the second structural component 12 and the third structural component 13 are pivoted together via a second connecting element 15. The first structural component 11 has a securing aperture 111. The second structural component 12 has two first angle brackets 16 adjacent to the first structural component 11, and the first angle brackets 16 each include a sliding slot 161. The sliding slot 161 is an elongate strip slot with a front semicircular end 162 and a rear semicircular end 163. The third structural component 13 has two second angle brackets 17 adjacent to the second structural component 12, and each second angle bracket 17 includes an aperture 171. The securing aperture 111, the first angle bracket 16, and the second angle bracket 17 of the primary frame 10 are all disposed along a same direction, and the sliding slot 161 of the first angle bracket 16 is parallel with the second structural component 12. The driver may include an electrical motor, a pneumatic device or a hydraulic device. The driver has a positioning portion 21 at one end and an extendable rod 22 at another end, and the positioning portion 21 is pivoted to the securing aperture 111 of the first structural component 11 by way of a first pin 211. The extendable rod 22 includes a through hole 221 at an end of the extendable rod 22, and the through hole 221 is aligned with the sliding slot 161 of the second structural component 12. The link rod 30 has a first aperture 31 at one end and a second aperture 32 at another end. The first aperture 31 is pivoted to the through hole 221 of the driver 20 with a control pin 33, and the control pin 33 is slibable in, and limited in, the sliding slot 161 of the second structural component 12. The second aperture 32 and the aperture 171 of the third structural component 13 are pivoted together with a second pin 34 such that the driver 20 drives the link rod 30 to affect different movements of the main frame.

For the assembly of the present invention, please refer again to FIGS. 1, 2 and 3. The primary frame 10 is a combination of the first structural component 11, the second structural component 12 and the third structural component 13. The first structural component 11 and the second structural component 12 are pivoted together with the first connecting element 14, and the second structural component 12 and the third structural component 13 are pivoted together with the second connecting element 15. The securing aperture 111, the first angle bracket 16 and the aperture 171 of the primary frame 10 are all disposed along the same direction, such that the driver 20 is connected between the securing aperture 111 and the first angle bracket 16. The link rod 30 is used for connecting the first angle bracket 16 and the second angle bracket 17, and the positioning portion 21 of the driver 20 is pivoted to the securing aperture 111 of the first structural component 11 with the first pin 211. The second aperture 32 of the link rod 30 is disposed between the two second angle brackets 17, the second pin 34 is placed through the second aperture 32 and the aperture 171, and the through hole 221 of the driver 20 and the first aperture 31 of the link rod 30 are both disposed between the two first angle brackets 16 of the second structural component 12. Therefore, the control pin 33 can be placed through the through hole 221 and the first aperture 31 and slidable in the sliding slot 161, and the control pin 33 is able to slide between the front semicircular end 162 and the rear semicircular end 163.

Figure 3:
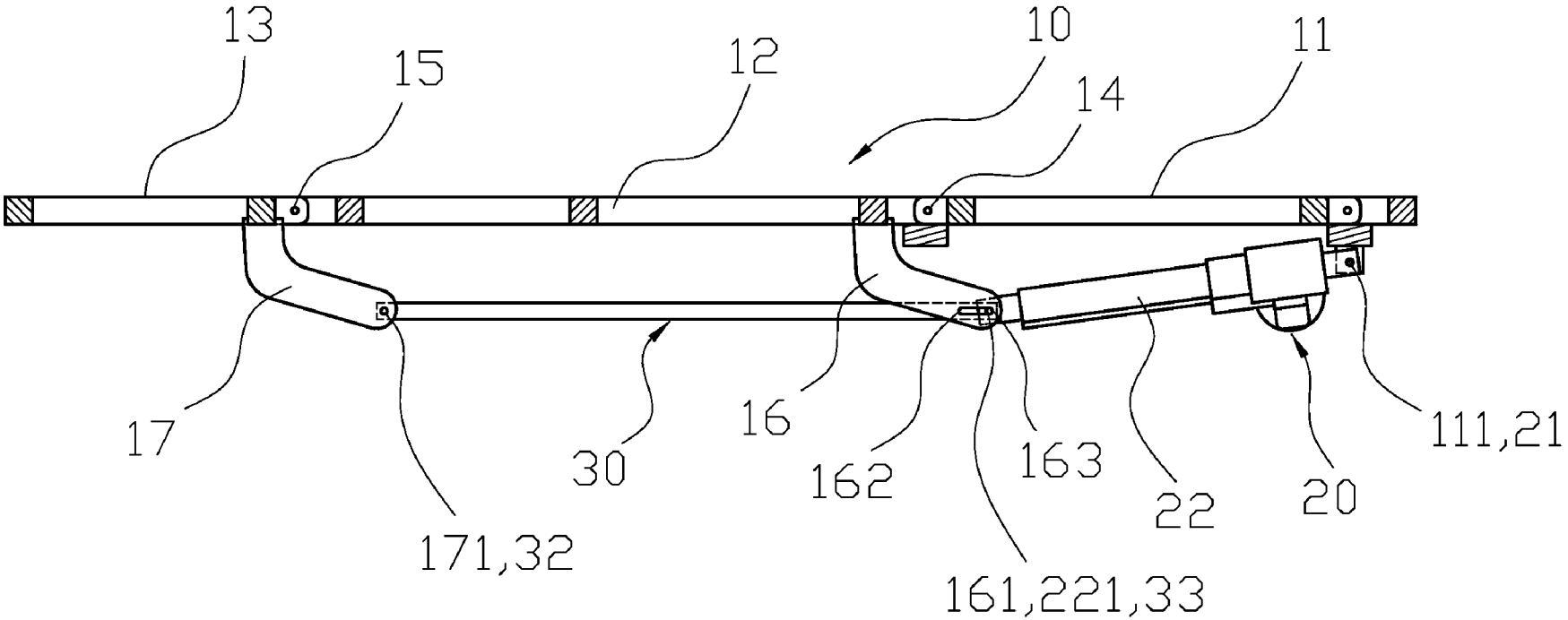
FIG. 3 is a schematic drawing of movement of an embodiment of the present invention.
Figure 4:
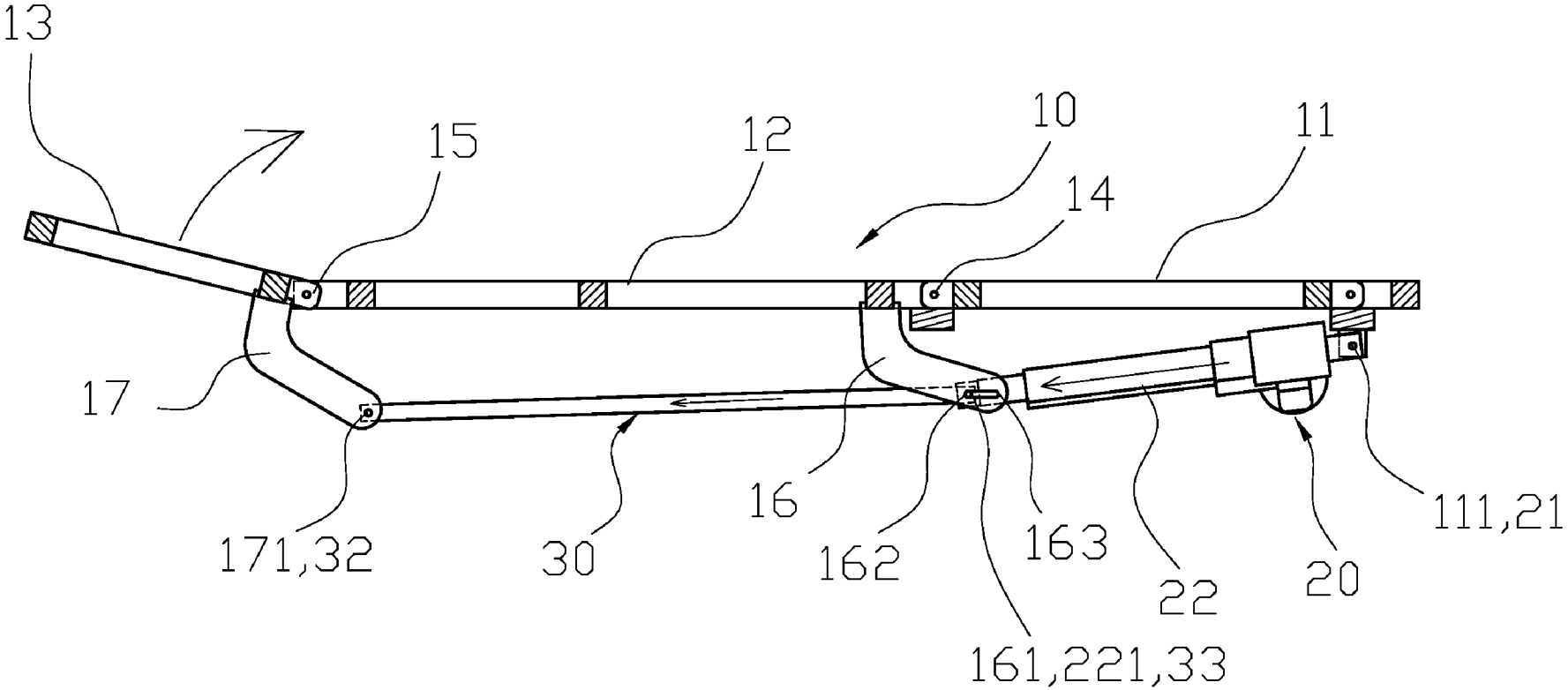
FIG. 4 is another schematic drawing of movement of an embodiment of the present invention.
Figure 5:
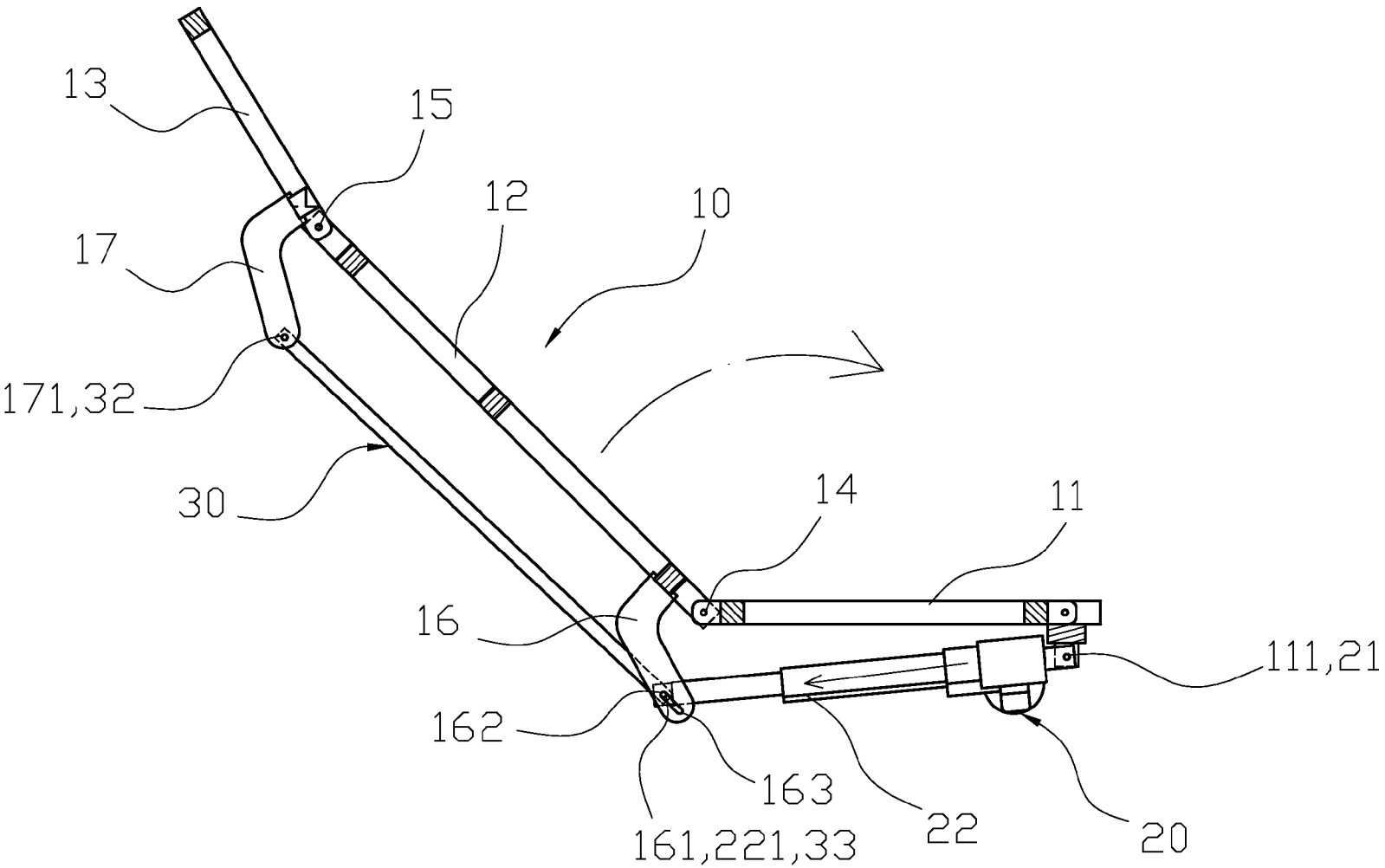
FIG. 5 is an exploded view of an embodiment of the present invention as applied to a bed frame.

For actual operational movement, please refer to FIGS. 3, 4 and 5 with reference to FIG. 2. When the extendable rod 22 is elongated by the driver 20, the driver 20 is secured by the securing aperture 111 of the first structural component 11 and pushes the extendable rod 22 to push the control pin 33 along the through hole 221, such that the control pin 33 is moved from the rear semicircular end 163 of the sliding slot 161 to the front semicircular end 162 of the sliding slot 161. Within the sliding range of the control pin 33, the first aperture 31 of the link rod 30 is driven by the control pin 33 and moves towards the second aperture 32, and so the link rod 30 pushes the second angle bracket 17 of the third structural component 13 to cause the third structural component 13 to generate a swinging movement around the second connecting element 15, while the second structural component 12 remains still. When the control pin 33 moved by the driver 20 pushes against the front semicircular end 162 of the sliding slot 161, with the acting force from the driver 20, the control pin 33 is able to directly push the first angle bracket 16 of the second structural component 12 such that the second structural component 12 generates a swinging movement around the first connecting element 14. When the control pin 33 presses against the front semicircular end 162, the link rod 30 causes the second structural component 12 and the third structural component 13 to pivot. Accordingly, the linkage movement first causes the third structural component 13 to pivot, and then causes the second structural component 12 to pivot.

Figure 6:
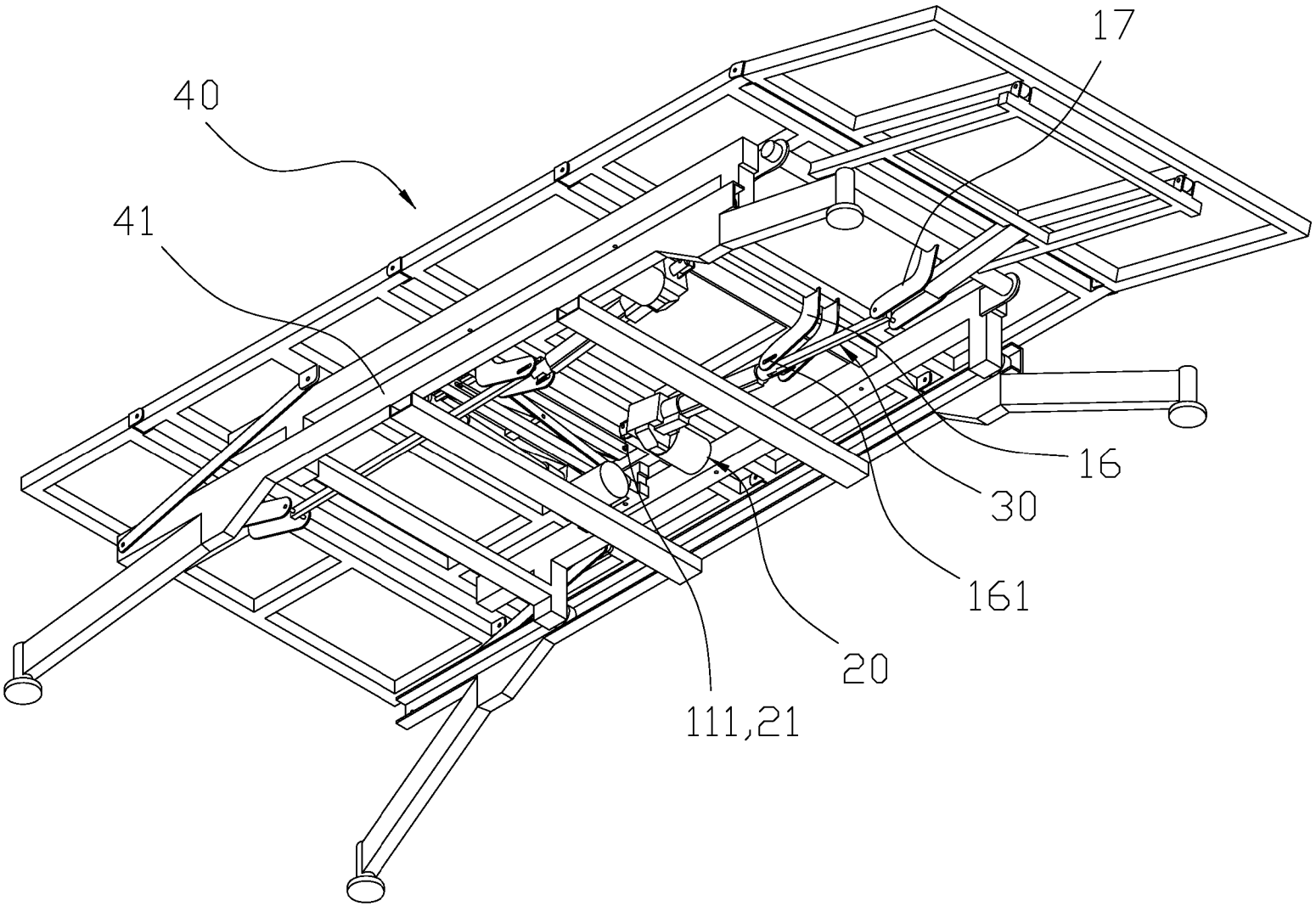
FIG. 6 is a schematic drawing of movement of a bed frame with an embodiment of the present invention.
Figure 7:
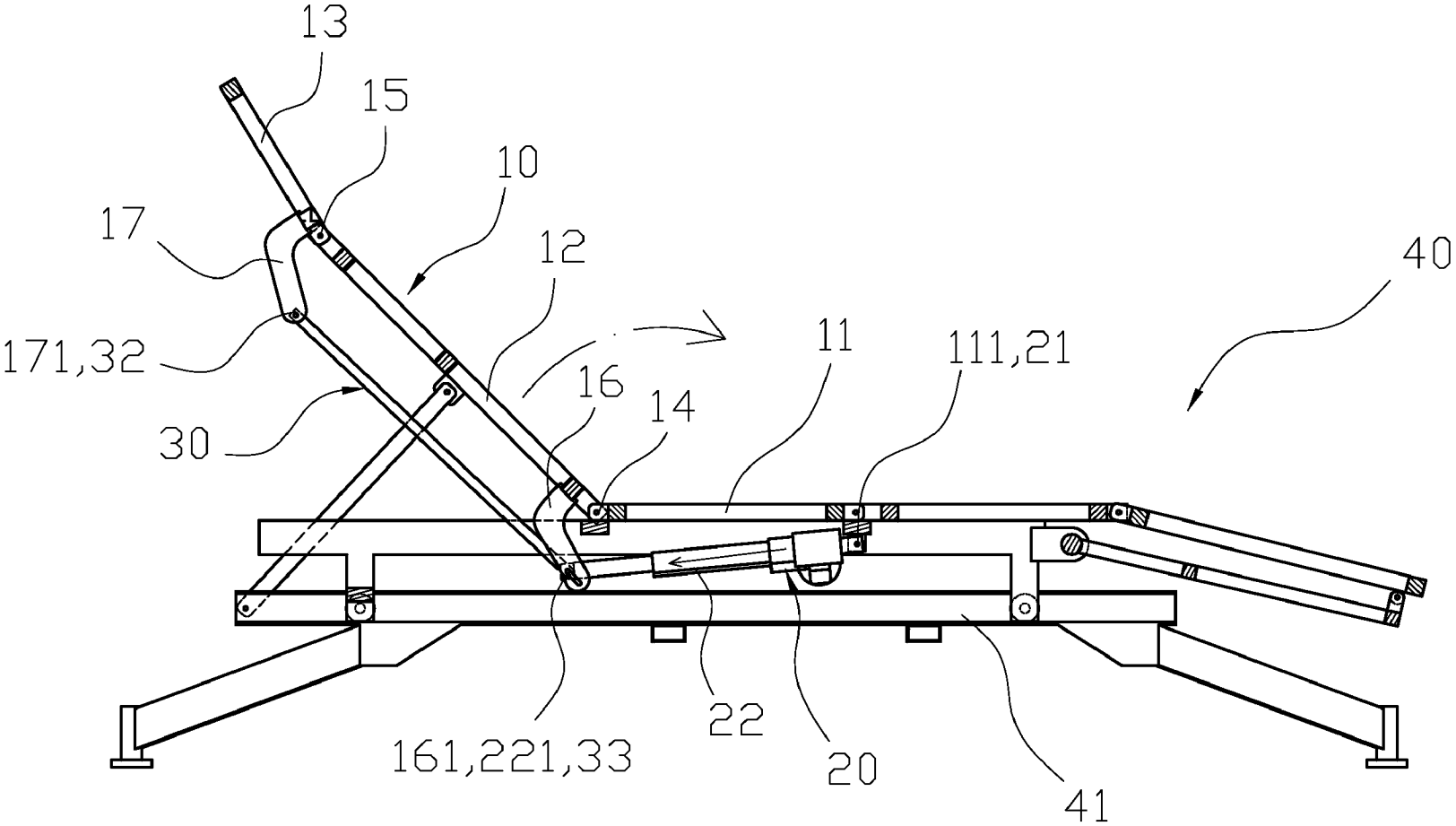
FIG. 7 is a schematic drawing of a rocking movement of an upper portion of an electric bed employing an embodiment of the present invention.
Figure 8:
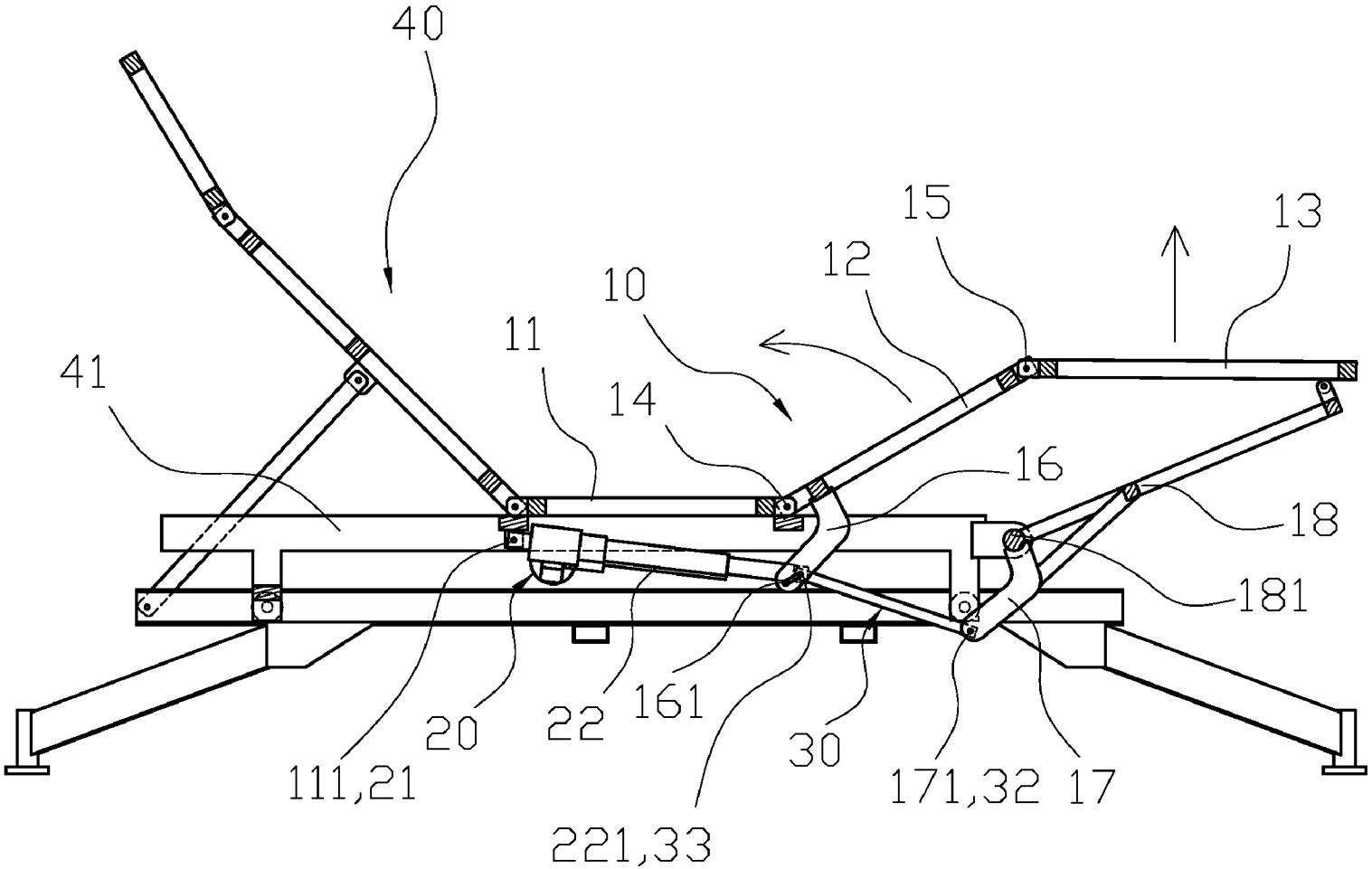
FIG. 8 is a schematic drawing of a rocking movement of a lower portion of an electric bed employing an embodiment of the present invention.

Please refer to FIG. 6 with reference to FIG. 2. The present invention may be suitably applied in an electric bed 40 and an electric chair. It can provide multiple lifting sections; for example, when a user lies on the electric bed 40 having the connecting structure of the present invention, the head of the user or the lower legs of the user can be lifted before the upper body or the lower body, which can provide more comfort to the user. Please refer to FIG. 7. FIG. 7 is a schematic drawing of the rocking movement of the upper half part of an electric bed that includes an embodiment of the present invention. The primary frame 10 has the first structural component 11 attached to the bed frame 41 of the electric bed 40, and the first structural component is connected to the second structural component 12 and the third structural component 13. The driver 20 is connected between the first structural component 11 and the second structural component 12, and the link rod 30 is connected between the second structural component 12 and the third structural component 13. When the driver 20 provides a pushing force to first pivot the third structural component 13, the second structural component 12 is then driven to be pivoted; therefore, the head of the user first lifts and then the upper body of the user is lifted, which is more comfortable for the user. Please refer to FIG. 8. FIG. 8 is a schematic drawing of the rocking movement of the lower half part of the electric bed with an embodiment of the present invention. The primary frame 10 has the first structural component 11 attached to the bed frame 41 of the electric bed 40 and connected to the second structural component 12 and the third structural component 13. The driver 20 is connected between the first structural component 11 and the second structural component 12, and the link rod 30 is connected between the second structural component 13 and the third structural component 12. The push bar 18 is disposed between the third structural component 13 and the second angle bracket 17, and a pivot member 181 is between the push bar 18 and the second angle bracket 17. Therefore, the second angle bracket 17 drives the outer edge of the third structural component 13. Accordingly, the lower legs of the user are lifted first and the upper legs of the user are lifted later, which is a more comfortable transition for the user.

With the above-mentioned structure, the present invention provides the following characteristics: when the driver 20 pushes the control pin 33 to slide in the sliding slot 161, before the control pin 33 presses against the front semicircular end 162, only the third structural component 13 is pivoted; when the control pin 33 reaches the front semicircular end 162 and presses against the front semicircular end 162, the second structural component 12 is pivoted too.

Although the present invention has been explained in relation to its preferred embodiment, it is to be understood that many other possible modifications and variations can be made without departing from the spirit and scope of the invention as hereinafter claimed.

What is claimed is:

1. A single driver connecting structure for an electrical bed or chair comprising:

a primary frame comprising a first structural component, a second structural component and a third structural component; the first structural component and the second structural component being pivoted together via a first connecting element, and the second structural component and the third structural component being pivoted together via a second connecting element; the first structural component having a securing aperture; the second structural component having at least one first angle bracket adjacent to the first structural component, the first angle bracket including a sliding slot; the third structural component having at least one second angle bracket adjacent to the second structural component, the second angle bracket including an aperture;

a driver having a positioning portion at one end and an extendable rod at another end, the positioning portion pivoted to the securing aperture of the first structural component by way of a first pin, the extendable rod including a through hole at an end of the extendable rod, the through hole aligned with the sliding slot of the first angle bracket of the second structural component; and a link rod having a first aperture at one end and a second aperture at another end, the first aperture pivoted to the through hole of the driver with a control pin, the control pin slidable in and limited in the sliding slot of the first angle bracket of the second structural component, the second aperture and the aperture of the second angle bracket of the third structural component pivoted together with a second pin such that the driver drives the link rod to affect different movements of the primary frame.

2. The single driver connecting structure as claimed in claim 1, wherein the securing aperture, the first angle bracket, and the second angle bracket of the primary frame are all disposed along a same direction, and the sliding slot of the first angle bracket is substantially parallel with the second structural component.

3. The single driver connecting structure as claimed in claim 1, wherein the sliding slot of the first angle bracket is an elongate strip slot with a front end and a rear end.

4. The single driver connecting structure as claimed in claim 1, wherein the driver is an electrical motor.

5. The single driver connecting structure as claimed in claim 1, wherein the driver is a pneumatic device.

6. The single driver connecting structure as claimed in claim 1, wherein the driver is a hydraulic device.

7. The single driver connecting structure as claimed in claim 1, wherein the third structural component has two second angle brackets.

8. The single driver connecting structure as claimed in claim 1, wherein the second structural component has two first angle brackets.

* * * * *